United States Patent [19]

Weber

[11] Patent Number: 5,014,766

[45] Date of Patent: May 14, 1991

[54] FOUNDRY CORE SHOOTER

[75] Inventor: Andre Weber, Saverne, France

[73] Assignee: Kuhn S.A., Saverne, France

[21] Appl. No.: 481,211

[22] Filed: Feb. 20, 1990

[30] Foreign Application Priority Data

Feb. 24, 1989 [FR] France ..... 8902633

[51] Int. Cl.[5] ..... B22C 11/04; B22C 15/24; B22C 19/04

[52] U.S. Cl. ..... 164/154; 164/200; 164/201

[58] Field of Search ..... 164/200, 201, 202, 154, 164/16, 456

[56] References Cited

U.S. PATENT DOCUMENTS

| | | | |
|---|---|---|---|
| 3,059,294 | 10/1962 | Dunn et al. | 164/16 X |
| 3,620,293 | 11/1971 | Kruse | 164/154 |
| 4,079,776 | 3/1978 | Niedermeyer | 164/154 |
| 4,190,097 | 2/1980 | Allread et al. | 164/16 X |
| 4,742,862 | 5/1988 | Weber | 164/154 |

FOREIGN PATENT DOCUMENTS

| | | |
|---|---|---|
| 3148461 | 4/1983 | Fed. Rep. of Germany . |
| 647433 | 1/1985 | Switzerland . |

*Primary Examiner*—J. Reed Batten, Jr.

*Attorney, Agent, or Firm*—Oblon, Spivak, McClelland, Maier & Neustat

[57] ABSTRACT

A core shooter comprises a support device for core boxes. The support device is equipped with support elements which can receive core boxes of variable dimensions. The core shooter further comprises a shooting mechanism which comprises a shooting device and an adaptation which provides for device the automatic adaptation device of the shooting to the dimension of the core boxes. The core shooter further comprises a gassing mechanism comprising a gassing head and a further adaptation device. The further adaptation device providing for the automatic adaptation of the gassing head to the dimension of the core boxes. Additionally, the shooting device comprises a plurality of shooting heads.

8 Claims, 8 Drawing Sheets

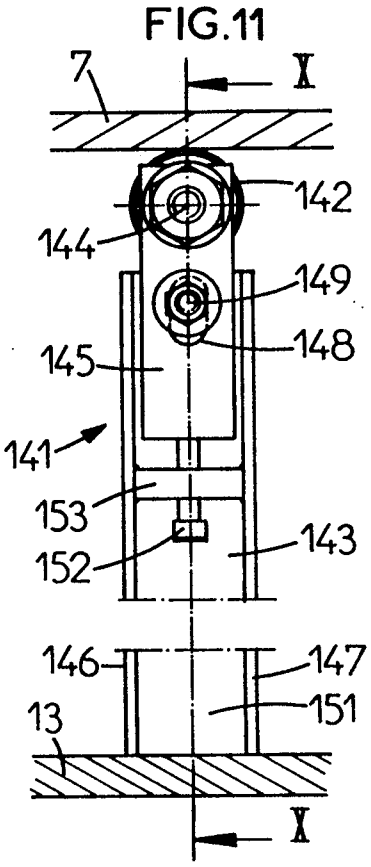
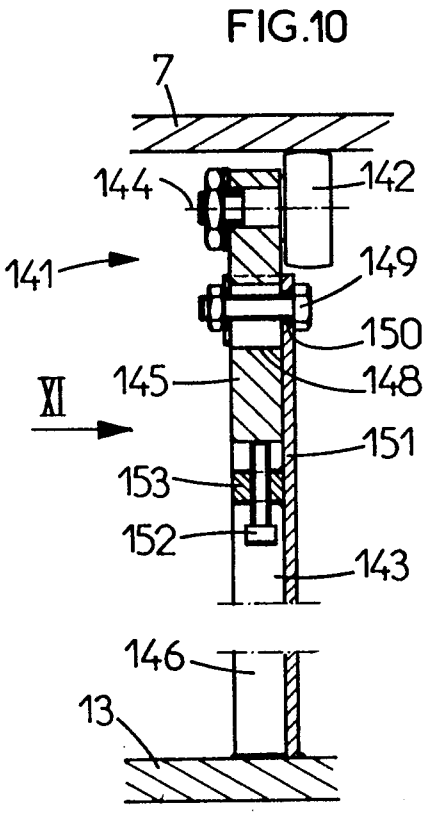
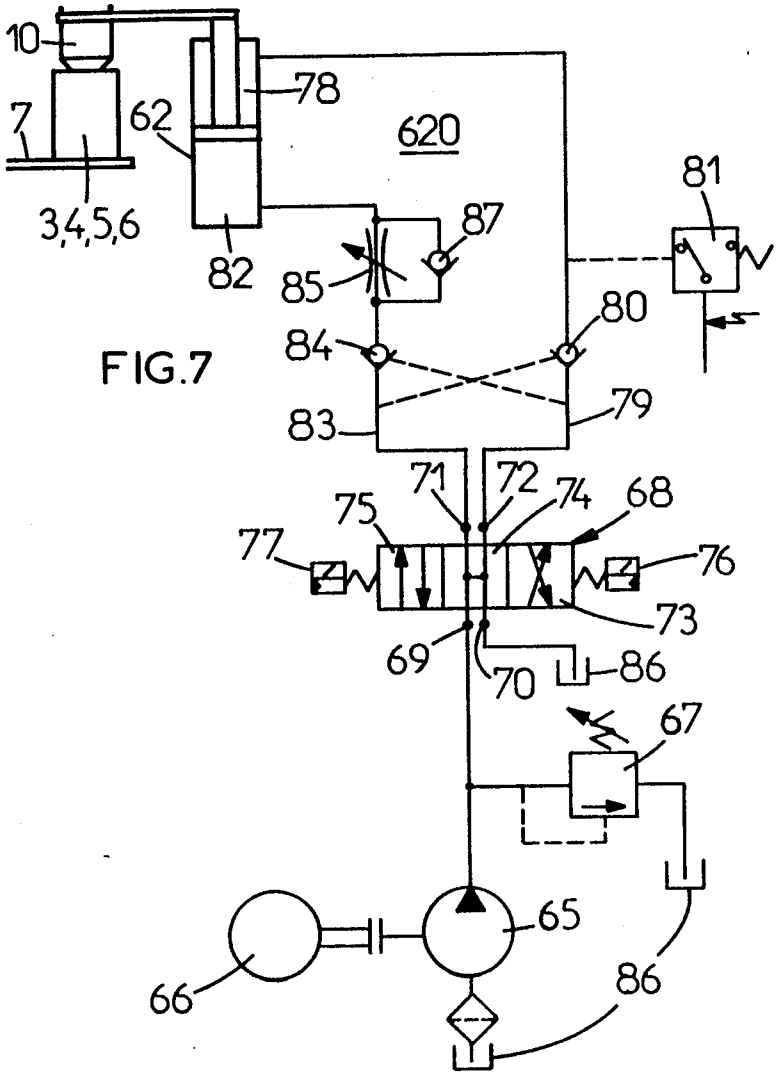
FIG.7

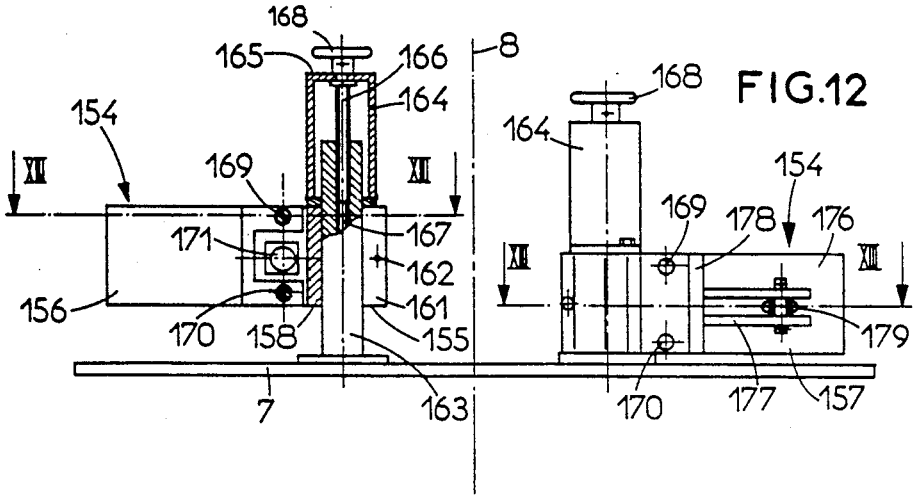
FIG.12
FIG.13
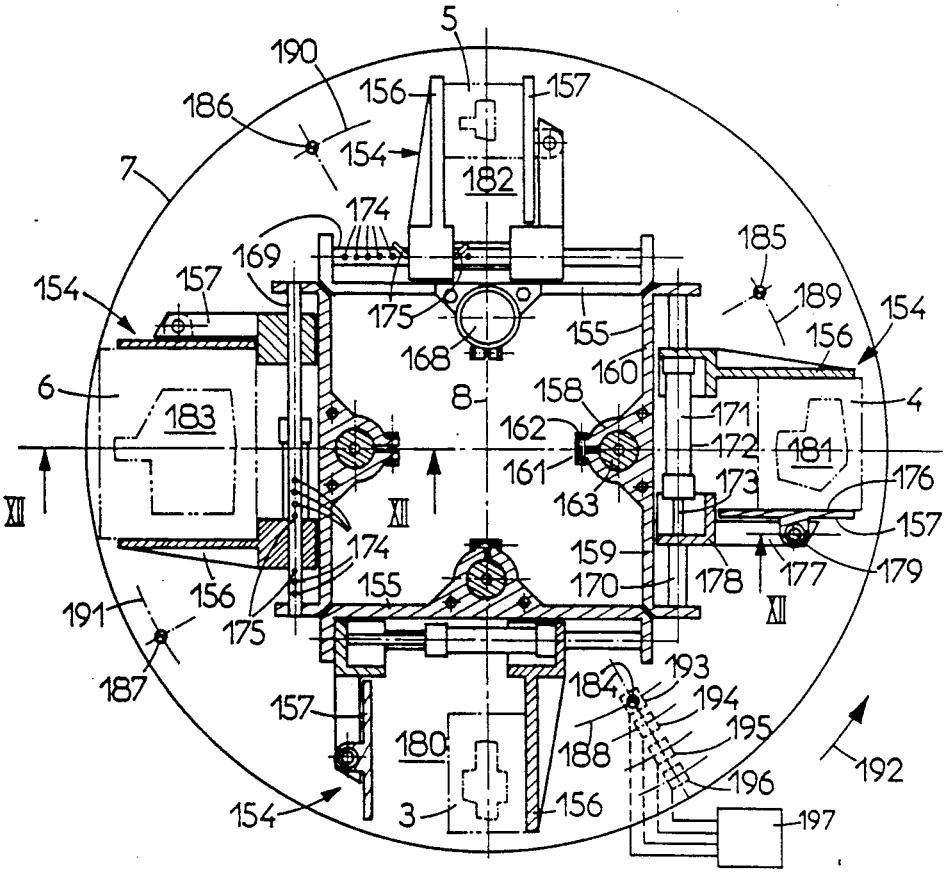

FOUNDRY CORE SHOOTER

BACKGROUND OF THE INVENTION

1. Field of the Invention

This invention relates to a core shooter comprising a support means for core boxes equipped with support elements which can receive core boxes of variable dimension, a shooting means comprising a shooting device as well as adaptation means which make it possible for the shooting device to adapt automatically to the dimension of the core boxes and a gassing means comprising a gassing head and adaptation means which make it possible for the gassing head to adapt automatically to the dimension of the core boxes.

2. Description of the Related Art

Such a core shooter is described in EP-A-0 238 428. This known machine is particularly versatile and makes it possible to make the production of cores extremely flexible. More specifically, it makes it possible to produce different cores simultaneously, so that if a part to be molded comprises several cores, the casting of the parts can begin at approximately the same time as the production of cores, while using only a single machine.

In addition, this machine can serve equally in large- or small-scale production of cores. The machine then can be adapted exactly to the series of cores to be produced, which makes it possible to obtain, in each case, the smallest possible costs and production times. Actually, in the case of large-scale production, it is possible to equip all the work stations of the machine with identical core boxes. The machine thus will produce the same core all the time. In the case of small-scale production, it is possible to equip each work station of the machine with a different box. The machine thus will produce several different cores simultaneously, but in a smaller amount. Any intermediate case, located between these two extreme cases, can be considered, of course. Thus, in the case of a middle series, only some stations of the machine will be equipped with identical boxes. Therefore, the machine, as has just been demonstrated, has a very great flexibility of use.

Moreover, since the machine accepts core boxes of variable dimension, the buyer of such a machine can use the existing boxes in a great majority of cases. In this way, the machine is very quickly operational.

SUMMARY OF THE INVENTION

Accordingly, one object of this invention is to make this known machine still more flexible.

For this purpose, the machine according to this invention is characterized by the fact that the shooting device comprises several shooting heads, thus making it possible to shoot cores with different sands. It also is possible to shoot cores of very different shape requiring sand output nozzles of the shooting head of different shape.

The ability to shoot cores with different sands is extremely advantageous. In fact, in the machine of the prior art, a change of sand required stopping the machine and cleaning the sand supply system, a process which requires a relatively great installation time. In the machine according to this invention, it is sufficient simply to supply each core box with the suitable shooting head.

According to an additional feature of the invention, the shooting heads can be used individually.

According to another feature of this invention, it is provided that each shooting head comprises an individual metering device and that a shooting unit is common to at least one part of the said shooting heads Because of this arrangement, the design of the machine according to the invention is extremely simple. Moreover, due to the fact that there is only one shooting unit which represents the expensive element of the shooting head, for at least one part of the said shooting heads, it is possible to limit the price increase of the machine produced by the arrangement of several shooting heads.

An extremely simple embodiment is obtained when the shooting unit is stationary and the metering device, adapted to the shooting core box to be shot, is brought under the shooting unit by a control device. Thanks to this characteristic, it is extremely easy to arrange the various supply systems of the shooting heads.

Advantageously, the various metering devices are brought under the common shooting unit by movement in an at least substantially horizontal plane.

According to a preferred embodiment, this movement is a translation, but also could be, for example, a rotation around an at least approximately vertical axis.

According to another additional characteristic of the invention, the metering devices corresponding to a common shooting unit move jointly when the control device brings one of these metering devices under the common shooting unit. In this case, a single control device can control the movement of the metering devices corresponding to the same shooting unit.

According to another additional characteristic of the invention, the metering devices corresponding to the same shooting unit move jointly when the shooting head which is operational is moved near or away from the core box. This also greatly simplifies the design of the machine.

According to another additional characteristic of the invention, each metering device extends, in the nonuse position, under a corresponding sand supply. Thus, the metering device which is to be brought under the shooting unit by the control device is already in place for the filling before being brought under the shooting unit. Unnecessary movements and time losses thus are prevented.

In a particularly advantageous design, the sand supplies intended to supply the metering devices extend around the common shooting unit.

According to an additional characteristic of the invention, the metering devices of the various shooting heads comprise output nozzles of different shape. In this way, cores of varied dimension and shape can be shot successively during the same cycle.

The core shooter of the present invention comprises a support means for core boxes, the support means being equipped with support elements which can receive core boxes of variable dimensions;

a shooting means comprising a shooting device and first adaptation means, the first adaptation means providing for the automatic adaptation of the shooting device to the dimension of the core boxes; and a gassing means comprising a gassing head and second adaptation means, the second adaptation means providing for the automatic adaptation of the gassing head to the dimension of the core boxes;

wherein the shooting device comprises a plurality of shooting heads.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 7 shows the diagram of the hydraulic circuit of the cylinder for lowering and raising the shooting heads;

FIG. 10 shows a view in section along X (FIG. 11) of a support of the table;

FIG. 11 shows a view along arrow XI (FIG. 10) of the support shown in FIG. 10;

FIG. 12 shows a partial view along XII (FIG. 13) partially in section of the holding means of the core boxes;

FIG. 13 shows a top view partially in section along XIII (FIG. 12) of the holding means of FIG. 12 and the table;

DESCRIPTION OF THE PREFERRED EMBODIMENTS

Figure 1:
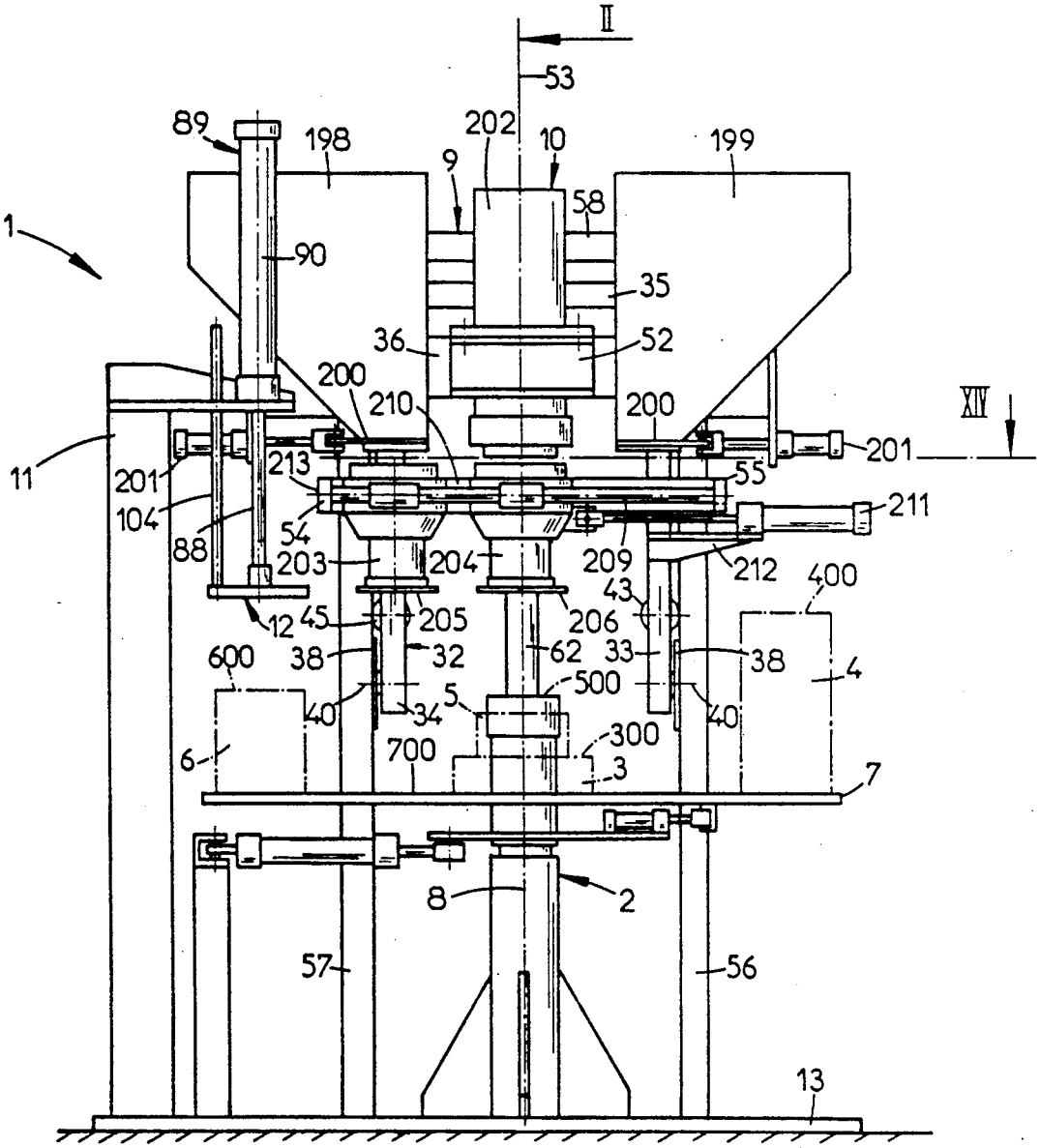
FIG. 1 shows a diagrammatic front view of the core shooter according to the invention.

Core shooter (1) of the invention comprises a support means (2) of core boxes (3; 4; 5; 6). This support means (2) comprises support elements which are, in the example shown, formed by a table (7) on whose upper face (700) core boxes (3; 4; 5; 6) are placed. This table (7) is substantially horizontal and can turn around a rotation axis (8) which extends approximately vertically.

Machine (1) further comprises a gantry (9) which supports a shooting device (10). This shooting device (10) can move at least approximately vertically to be brought near and away from table (7).

Machine (1) also further comprises a bracket (11) which supports a gassing head (12). This gassing head (12) can also move at least approximately vertically to be brought near and away from table (7).

Support means (2), gantry (9), as well as bracket (11), are connected to a base (13) which makes it possible to fix machine (1) on the ground of a coring shop.

In FIG. 1, it also is seen that gantry (9) also supports two hoppers (198; 199) in each of which is a reserve of core sand. Hoppers (198; 199) can be supplied by the central reserve of the coring shop. The base of each hopper (198; 199) is equipped with a flap (200) whose opening and closing are controlled by a corresponding cylinder (201).

Figure 14:
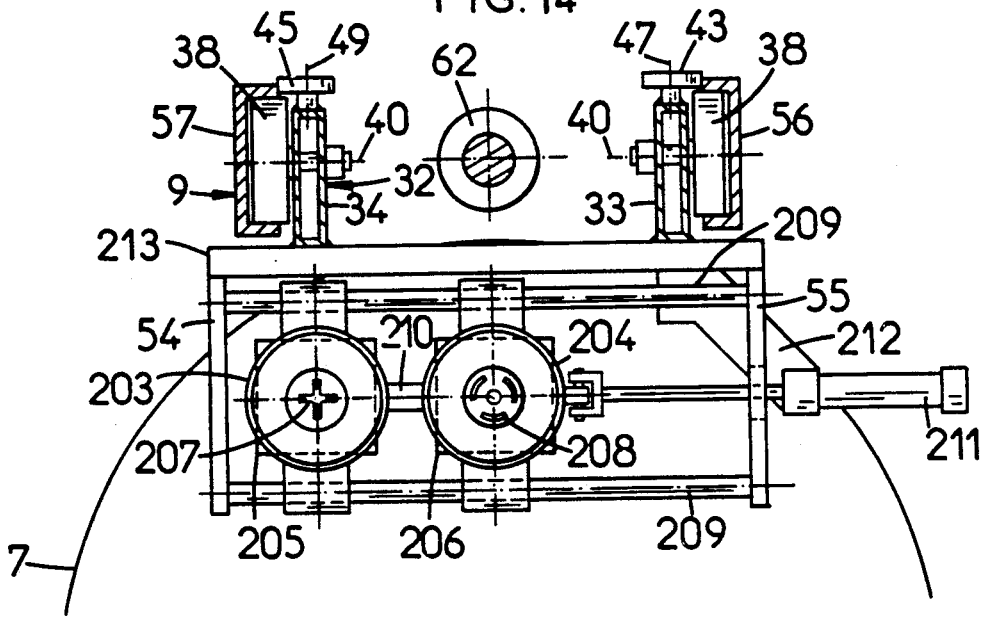
FIG. 14 shows a view in section along XIV (FIG. 1) of the shooting means.

Shooting device (10) first comprises a shooting unit (202) as well as two metering devices (203; 204) which each can be brought under shooting unit (202). Each unit (203-202; 204-202) thus forms a shooting head, so that the machine shown comprises two shooting heads. Shooting unit (202), as well as metering devices (203; 204) are known (of trademark FOMES, for example) and consequently are within the scope of one skilled in the art, so that they will not be described in detail. The only feature of metering devices (203; 204) resides in the fact that they each comprise a removable output nozzle (205; 206). In this way, it is possible to mount output nozzles (205; 206) exhibiting an output orifice (207; 208) of different shape on each metering device (203; 204). In FIG. 14, it is seen that output nozzle (205) equipping metering device (203) has an output orifice (207) having a cross shape, while output nozzle (206) equipping metering device (204) has an output orifice (208) having an essentially circular shape.

The two metering devices (203; 204) are mounted on two slides (209) extending under shooting unit (202) in an at least approximately horizontal plane and parallel to one another. The two metering devices (203; 204) are connected to one another in addition by a connecting element (210) so that they move jointly along the slides (209). The translation of metering devices (203; 204) along slides (209) is made by a control cylinder (211) which is connected, on one hand, to one (204) of the metering devices (203; 204), and, on the other hand, to a carriage (32) which supports shooting device (10) and which will be described in detail later. For this purpose, the carriage (32) is equipped with a bracket (212) to which the cylinder of control cylinder (211) is attached.

Figure 15:
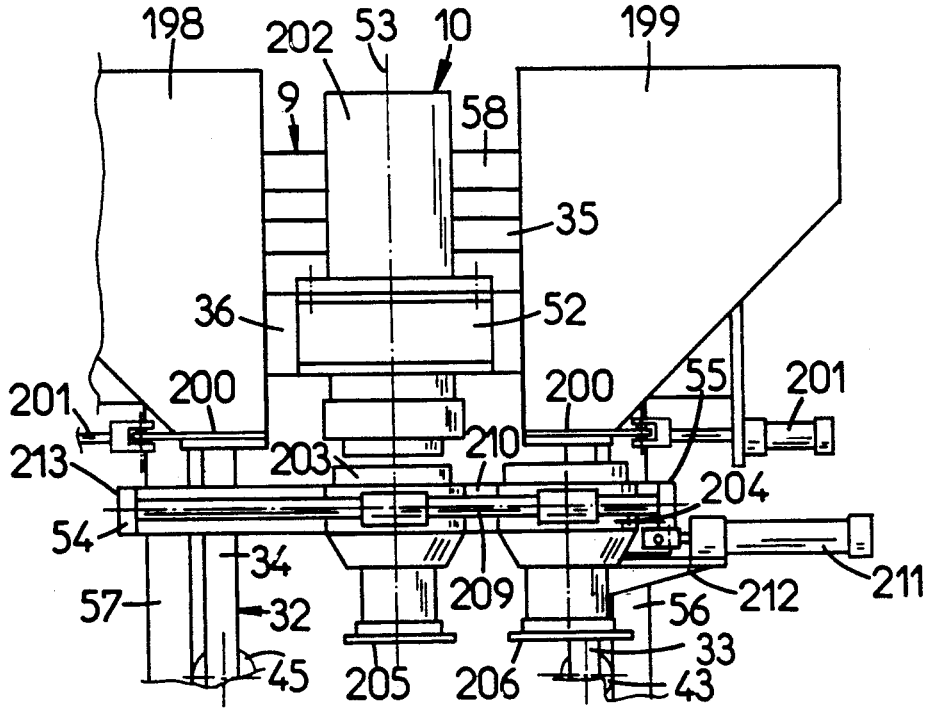
FIG. 15 shows a partial front view of the shooting means in which the metering devices have been translated.

In FIG. 1, it is shown that the two hoppers (198; 199) surround shooting unit (202) or, more precisely, extend on both sides of the shooting unit (202). Additionally, when one of the metering devices (203; 204) extends in its operational position under shooting unit (202), the other one of the metering devices (203; 204) extends under corresponding hopper (198; 199). In FIG. 1, metering device (204) has been shown in operational position under shooting unit (202) and metering device (203) in nonuse position under corresponding hopper (198). In FIG. 15, on the other hand, control cylinder (211) has translated metering devices (203; 204) so that metering device (203) extends in its operational position under shooting unit (202) and metering device (204) extends under corresponding hopper (199).

Figure 3:
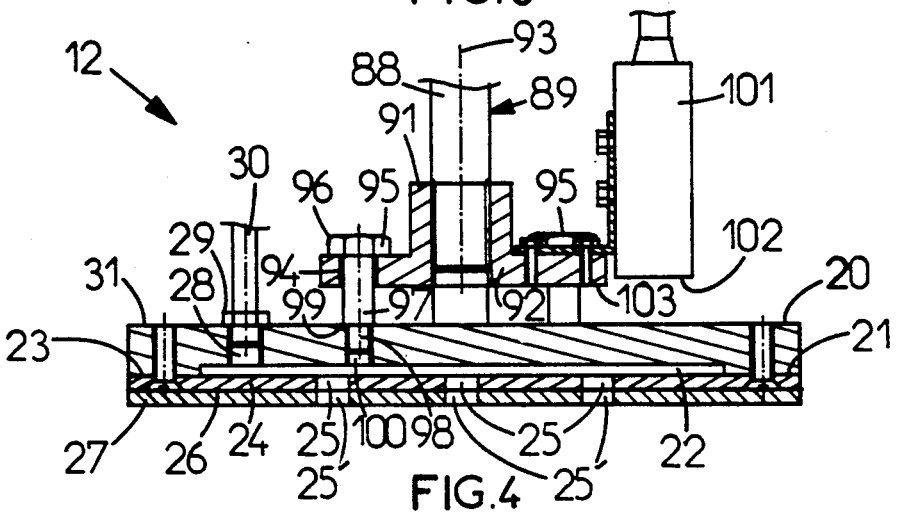
FIG. 3 shows a front view in section along III of the gassing head.
Figure 4:
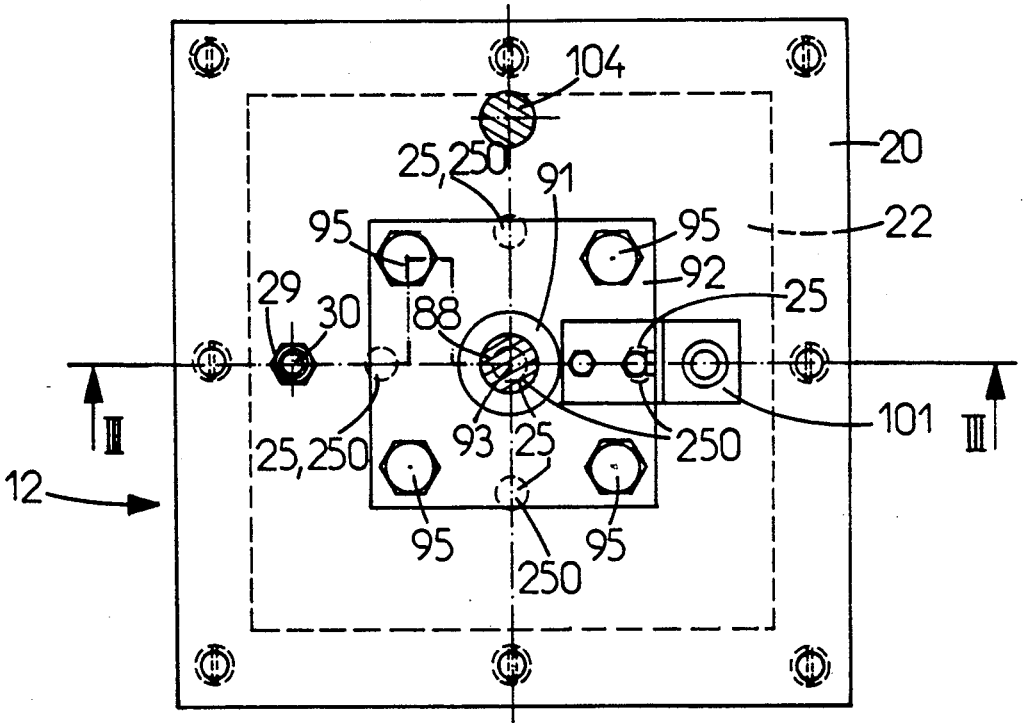
FIG. 4 shows a top view of the gassing head of FIG. 3, partially in section.
Figure 5:
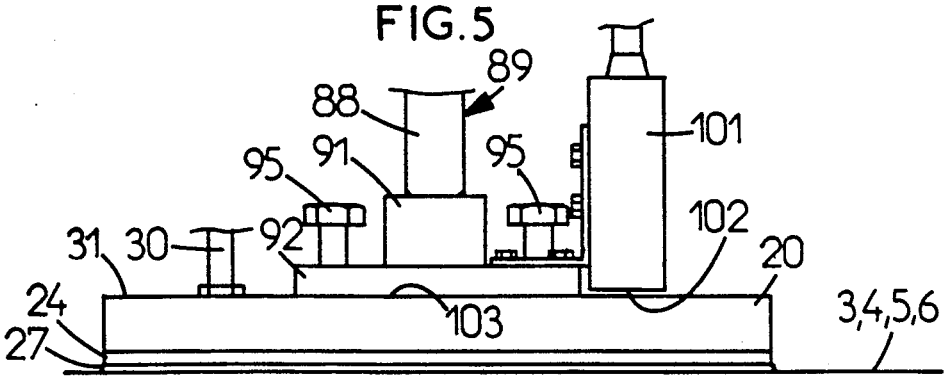
FIG. 5 shows a front view of the gassing head of FIGS. 3 and 4, in gassing position.

Gassing head (12) is shown in more detail in FIGS. 3, 4 and 5. This gassing head (12) consists of a plate (20), which comprises a cavity (22) in its lower face (21). A backplate (24) is attached to outer edge (23) of lower face (21) of plate (20), which delimits cavity (22). This backplate (24) is equipped with a certain number of holes (25) which go through backplate (24) and which come out in cavity (22). Backplate (24) also comprises a seal (27) on its lower face (26). This seal (27) comprises holes (25') which correspond to holes (25) of backplate (24) and which go through seal (27). Further, a threaded hole (28), which goes through plate (20) and which comes out in cavity (22), is provided in plate (20). Joining piece (29) of a gas intake pipe (30), which thus is attached to upper face (31) of plate (20), is screwed into threaded hole (28).

As stated above, shooting device (10) can be brought close to table (7) by automatically adapting to the dimension of core boxes (3; 4; 5; 6). For this purpose, shooting device (10) is mounted on carriage (32).

Figure 2:
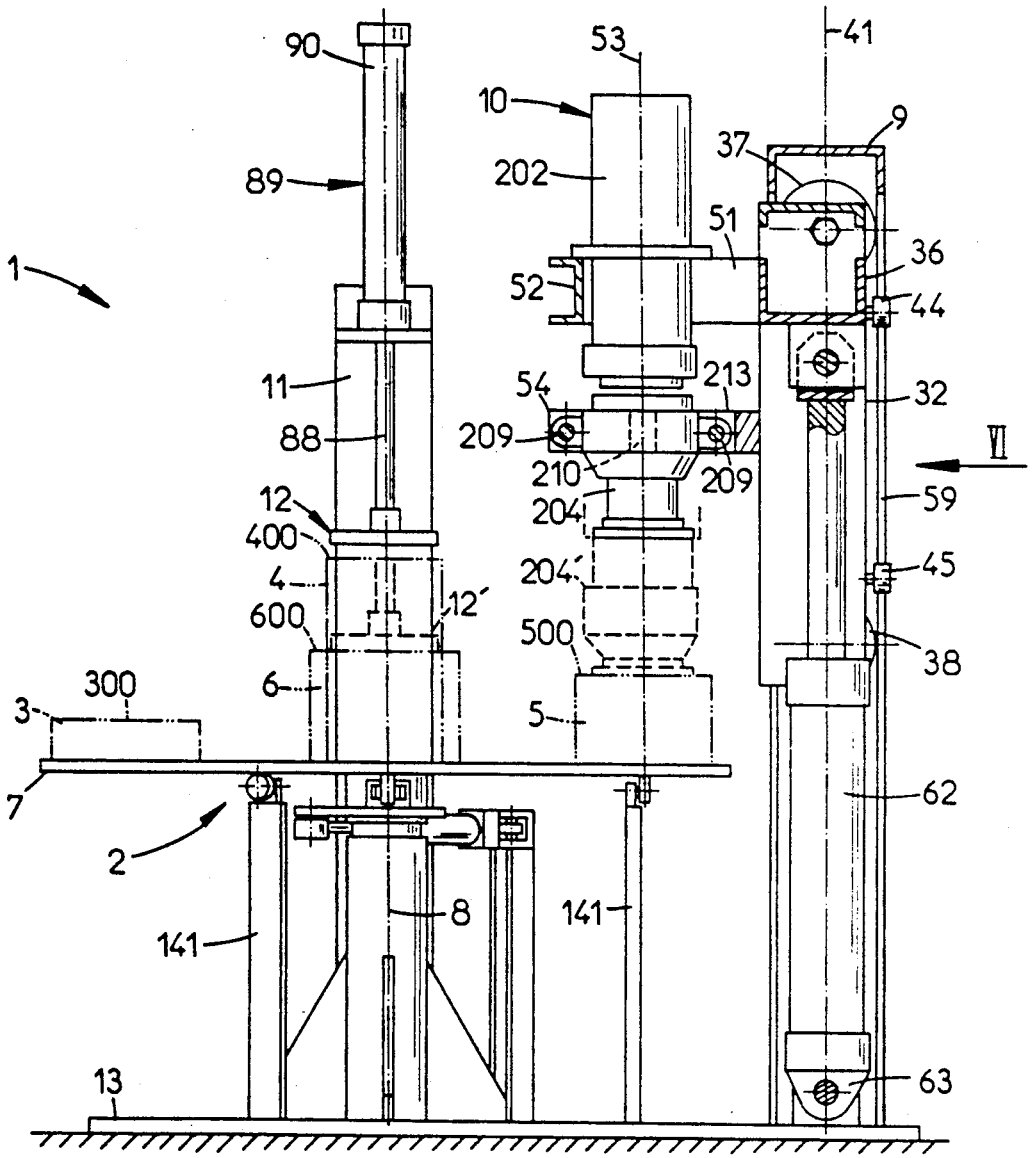
FIG. 2 shows a view along arrow II, partially in section, of the machine of FIG. 1.
Figure 6:
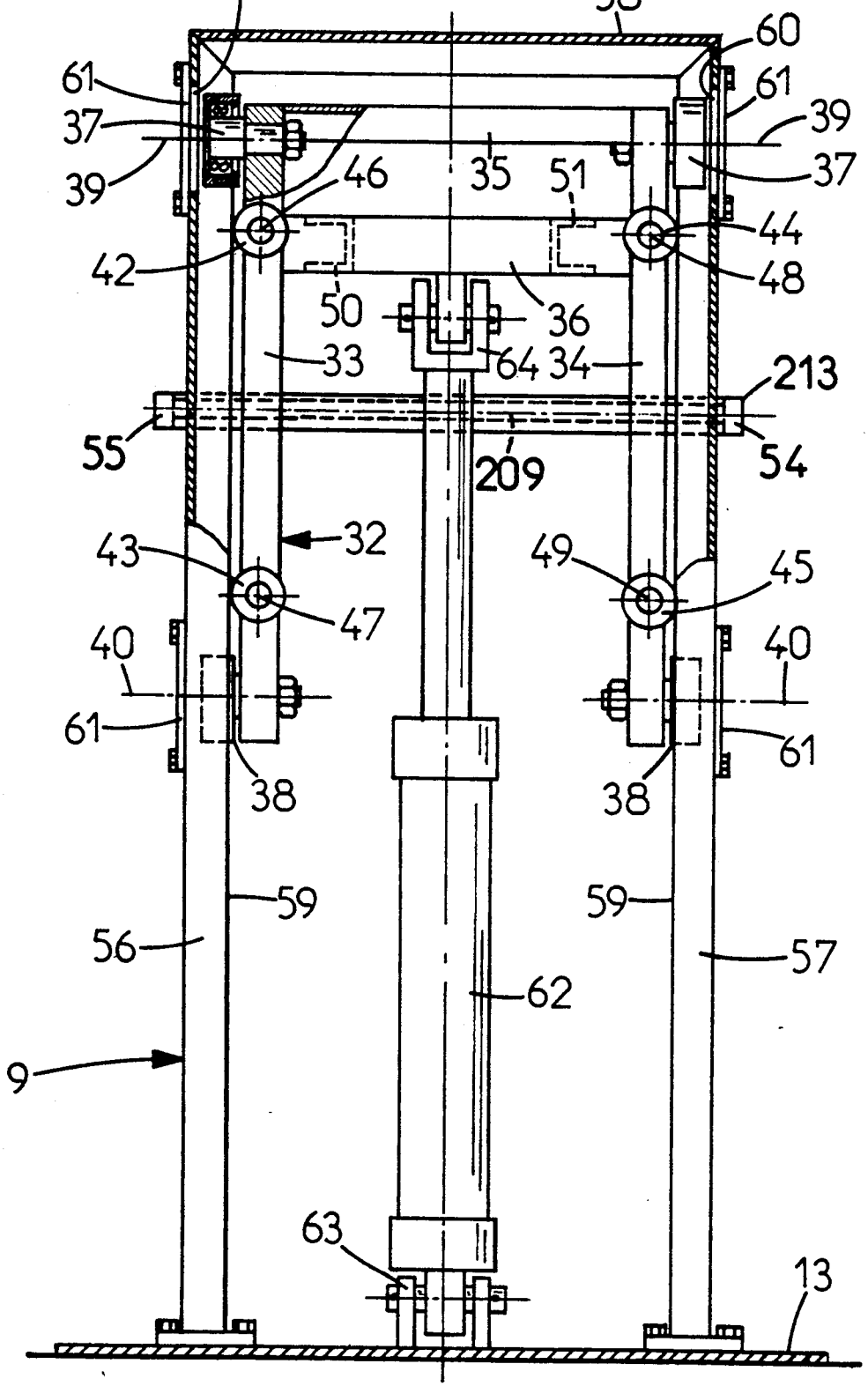
FIG. 6 shows a view along arrow VI (FIG. 2) of the gantry and carriage of the shooting head.
Figure 8:
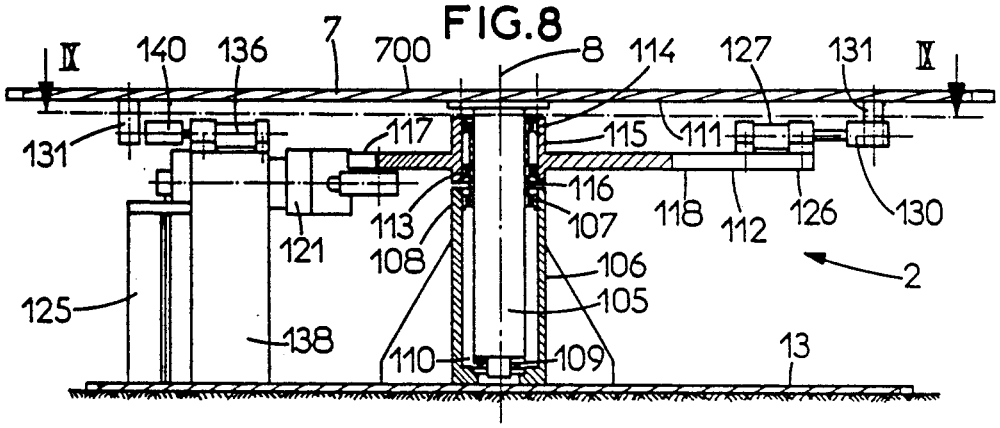
FIG. 8 shows a front view in section along VIII (FIG. 9) of the table.

Carriage (32) appears in detail in FIGS. 1, 2 and 6. It consists of two beams (33; 34) which are connected to one another at their upper part by two crossbeams (35; 36). Each beam (33; 34) is equipped at each of its ends with a roller (37; 38). Rotation axes (39; 40) of these rollers (37; 38) extend approximately horizontally and are contained in a plane approximately parallel to plane (41) of carriage (32).

Each beam (33; 34) is equipped with two other rollers (42; 43; 44; 45) which extend, as can be seen in FIG. 6, between rollers (37; 38). Rotation axes (46; 47; 48; 49) of rollers (42; 43; 44; 45) also extend approximately horizontally, but are approximately perpendicular to plane (41) of carriage (32).

Two approximately horizontal beams (50; 51), whose longitudinal axis extends approximately perpendicularly to plane (41) of carriage (32), are attached to lower crossbeam (36). The two beams (50; 51) are connected to one another by a crossbeam (52). The two beams (50; 51) and crossbeam (52) serve to attach shooting unit (202) to carriage (32), so that axis (53) of shooting unit (202) extends at least approximately vertically.

The two beams (33; 34) of carriage (32) also are equipped with a frame (213) comprising in particular two small beams (54; 55) which extend approximately parallel to beams (50; 51). These two small beams (54; 55) support the two slides (209) of metering devices (203; 204) of shooting device (10). The two slides (209) extend approximately parallel to plane (41) of carriage (32).

Carriage (32), which was just described, is guided in translation in gantry (9) due to rollers (37; 38) and rollers (42; 43; 44; 45). For this purpose, gantry (9) comprises two approximately vertical standards (56; 57) which are connected to one another at their upper end by a crossbeam (58). Gantry (9) thus formed is attached to base (13).

The two standards (56; 57) of gantry (9) consist of U-shaped sections whose open part is directed inside gantry (9). These two U-shaped standards (56; 57) serve as guide track for rollers (37; 38) when carriage (32) is moved in gantry (9). Rollers (42; 43; 44; 45) roll on rear wing (59) of U-shaped standards (56; 57) and serve to guide carriage (32) laterally. The guide tracks of rollers (37; 38) and (42; 43; 44; 45) can be equipped advantageously with a tempered steel part to prevent wear.

Standards (56; 57) of gantry (9) also comprise holes (60) plugged by removable covers (61). These holes (60) make possible the assembly and the disassembly of rollers (37; 38) and thereby the assembly and disassembly of carriage (32) of gantry (9).

The movement of carriage (32) with shooting device (10) in gantry (9) is performed by a cylinder (62) which advantageously is a hydraulic cylinder. This cylinder (62) extends approximately in plane (41) of carriage (32) and is attached on one hand to base (13) by a yoke (63) and on the other hand to lower crossbeam (36) of carriage (32) by another yoke (64).

The supply of this cylinder (62) is performed by a hydraulic circuit (620) which is shown in FIG. 7.

This circuit is supplied by a pump (65) driven by a motor (66). The pressure of the oil delivered by pump (65) is limited by a pressure relief valve (67). The circuit then comprises a distributor (68) with its four terminals (69; 70; 71; 72), its slide valve with three compartments (73; 74; 75) and its two pushers (76; 77). Terminal (72) of distributor (68) is connected to chamber (78) of cylinder (62) on the rod side of the cylinder by a pipe (79) comprising a controlled nonreturn valve (80) and a pressure switch (81). Terminal (71) of distributor (68) is connected to another chamber (82) of cylinder (62) by a pipe (83) comprising a controlled nonreturn valve (84) and a flow regulator (85).

The circuit which was just described operates in the following manner. To bring shooting device (10) close to the core box to be shot, pusher (76) of distributor (68) is energized, which brings compartment (73) to the level of terminals (69; 70; 71; 72). The oil delivered by pump (65) then enters through terminal (69), goes out through terminal (72), goes through valve (80) and enters into chamber (78) on the rod side of cylinder (62). The oil contained in chamber (82) is driven back when the pressure of pipe (79) has opened controlled valve (84). This driven-back oil of chamber (82) of cylinder (62) goes through flow regulator (85) which adjusts the reentry rate of the rod of cylinder (62), i.e. the lowering rate of carriage (32) and shooting device (10).

When shooting head (203-202; 204-202) comes into contact with upper face (300; 400; 500; 600) of shooting core box (3; 4; 5; 6), its lowering is stopped just as is the reentry of the rod of cylinder (82) in the cylinder of the cylinder (62). As pipe (79) continues to be supplied, the oil contained in the latter increases in pressure until reaching the rating pressure of pressure switch (81). At this time, pressure switch (81) deenergizes pusher (76), which has the result of returning compartment (74) to the level of terminals (69; 70; 71; 72). Doing this, the oil contained in chambers (78; 82) of cylinder (62) can no longer circulate because it is blocked by valves (80 and 84) and cylinder (62), i.e. carriage (32) and shooting device (10) are locked. The oil that pump (65) continues to deliver returns directly to tank (86).

After the shooting of the core, it is necessary to have shooting device (10) raised, i.e. the rod of cylinder (62) must come out again from the cylinder. To do this, pusher (77) is energized, which has the result of bringing compartment (75) to the level of terminals (69; 70; 71; 72). The oil delivered by pump (65) enters through terminal (69), goes out through terminal (71), passes through valve (84) and through nonreturn valve (87), which in this direction shortcircuits the flow regulator (85) to enter chamber (82) of cylinder (62), as soon as the pressure in pipe (83) has controlled the opening of valve (80) of pipe (79) so that the oil contained in chamber (78) of cylinder (62) can return to tank (86).

Thanks to this arrangement, it therefore is seen that shooting device (10) can adapt automatically to core boxes (3; 4; 5; 6) of very different dimension, since the core box itself triggers the stopping of the lowering of shooting device (10). Also the core box automatically locks shooting device (10) during the shooting of the core. This is very advantageous because it makes it possible for the machine to absorb the impact generated during the shooting of the core.

Further, it is seen that the arrangement of this circuit also makes possible the automatic unlocking of shooting device (10) before the raising of the shooting device (10).

Gassing head (12) also can be brought close to table (7) by adapting automatically to the dimension of core boxes (3; 4; 5; 6). For this purpose, gassing head (12) is attached to the free end of rod (88) of a cylinder (89) which advantageously is a pneumatic cylinder. Cylinder (90) of cylinder (89) is attached to bracket (11). The connection between the free end of rod (88) of cylinder (89) and gassing head (12) comes out in more detail in FIGS. 3, 4 and 5. In these figures, it is seen that the free end of rod (88) of cylinder (89) is screwed into a flange (91) whose cover (92) extends approximately perpendicularly to longitudinal axis (93) of rod (88). This cover (92) is equipped with four holes (94) which bolts (95) go through. These bolts (95) are of special shape. Actually, under their head (96), the shank of the bolts (95) comprises a first part (97) of a certain diameter and a certain length, to which a second part (98) of a smaller diameter than the diameter of first part (97) then is connected, so that between these two parts (97; 98), there is a shoulder (99). Second part (98) of the shank of bolts (95) is threaded so that bolts (95) can be screwed into threaded holes (100) provided in upper face (31) of plate (20), so that shoulder (99) just abuts on upper face (31) of plate (20). After tightening bolts (95), head (96) of bolts (95) thus is at a certain distance from upper face (31) of plate (20). In FIG. 3, it also is seen that the diameter of holes (94) of cover (92) of flange (91) is somewhat greater than the diameter of first part (97) of bolts (95). It also is seen that the thickness of cover (92) is slighter than the distance which separates the lower face of heads (96) of bolts (95) and upper face (31) of plate (20).

Further, a known end-of-travel detector (101) is attached to cover (92) of flange (91), so that lower face (102) of the end-of-travel detector (101) is slightly set back relative to lower face (103) of cover (92) located opposite upper face (31) of plate (20).

To prevent gassing head (12) from being able to turn relative to rod (88) of cylinder (89), plate (20) is equipped with a guide (104) attached to plate (20) and which goes through a guide hole made in bracket (11). The longitudinal axis of guide (104) is approximately parallel to the longitudinal axis of rod (88) of cylinder (89), i.e. approximately vertical.

Gassing head (12) and its adaptation means which make it possible for gassing head (12) to adapt automatically to the dimension of core boxes (3; 4; 5; 6) operate in the following manner. When a core box (3; 4; 5; 6) is in gassing position (core box (6), for example, in FIGS. 1 and 2), cylinder (89) is supplied, which causes the lowering of gassing head (12) to the core box. When seal (27) comes into contact with upper face (300; 400; 500; 600) of the core box, the lowering of plate (20) stops. Cylinder (89), on the other hand, continues to push on flange (91) until lower face (103) of cover (92) of flange (91) comes into contact with upper face (31) of plate (20). The push of cylinder (89) on upper face (31) of plate (20) then compresses seal (27) between lower face (26) of backplate (24) and upper face (300; 400; 500; 600) of the core box to prevent gas leaks. When seal (27) is correctly compressed, the lowering of rod (88) of cylinder (89) stops, and pressure is maintained in cylinder (89) so that seal (27) remains correctly compressed during the entire gassing operation. This gassing operation begins only when gassing head (12) is in place. The triggering of the latter is performed by end-of-travel detector (101). Actually, this detector (101) detects upper face (31) of plate (20) when lower face (103) of cover (92) of flange (31) comes approximately close to upper face (31) of plate (20) (position shown in FIG. 5 which shows the gassing position). Given the possible relative movement between cover (92) of flange (91) and plate (20), this actually is achieved only when gassing head (12) is in contact with upper face (300; 400; 500; 600) of the core box. During the approach phase, on the other hand, the detection of upper face (31) of plate (20) cannot take place since upper face (31) of plate (20) is too removed from lower face (102) of detector (101) (position shown in FIG. 3).

During the gassing, the gas is brought by intake pipe (30) to cavity (22) from where it then is distributed through holes (25) of backplate (24) and holes (25') of seal (27) in the gassing core box.

The raising of gassing head (12) will be carried out after the gassing operation whose time is programmed as a function of the dimension of the core. This programming is done on a computer (197) which will be mentioned later.

Thanks to this arrangement, it therefore is seen that gassing head (12), as above shooting device (10), can adapt automatically to core boxes (3; 4; 5; 6) of very different dimension since the core box itself triggers the stopping of the lowering of gassing head (12) and the triggering of the gassing operation.

Support means (2) is shown in FIGS. 1, 2, 8, 9, 10 and 11, and comprises, as stated above, a table (7). This table (7) is preferably circular and, as stated above, extends approximately in a horizontal plane and can turn around a substantially vertical axis (8). Table (7) comprises for this purpose, approximately in its center, a pivot (105) which extends downward and whose longitudinal axis is merged with rotation axis (8) Pivot (105) fits into a bearing (106) which is attached to base (13). The guiding in rotation of pivot (105) in bearing (106) is performed with a roller bearing (107) which extends to upper part (108) of bearing (106) and with a roller thrust bearing (109) extending to lower part (110) of the bearing (106). Roller thrust bearing (109) also maintains pivot (105) axially downward. Bearing (106) does not extend to lower face (111) of table (7), so that between upper part (108) of bearing (106) and lower face (111) of table (7), pivot (105) can support a lever (112) in rotation. The guiding of lever (112) on pivot (105) is performed by two roller bearings (113; 114) housed in a hub (115) that lever (112) comprises. A certain distance is maintained between lever (112) and bearing (106) by a brace (116). Lever (112) comprises two arms (117; 118) of which one (117) extends on one side of hub (115) and the other (118) extends on the other side of the hub (115).

On its free end (119), arm (117) of lever (112) is connected to rod (120) of a cylinder (121) by a shaft (122). Cylinder (123) of cylinder (121) is connected in an articulated manner with a shaft (124) to a standard (125) integral with base (13).

Figure 9:
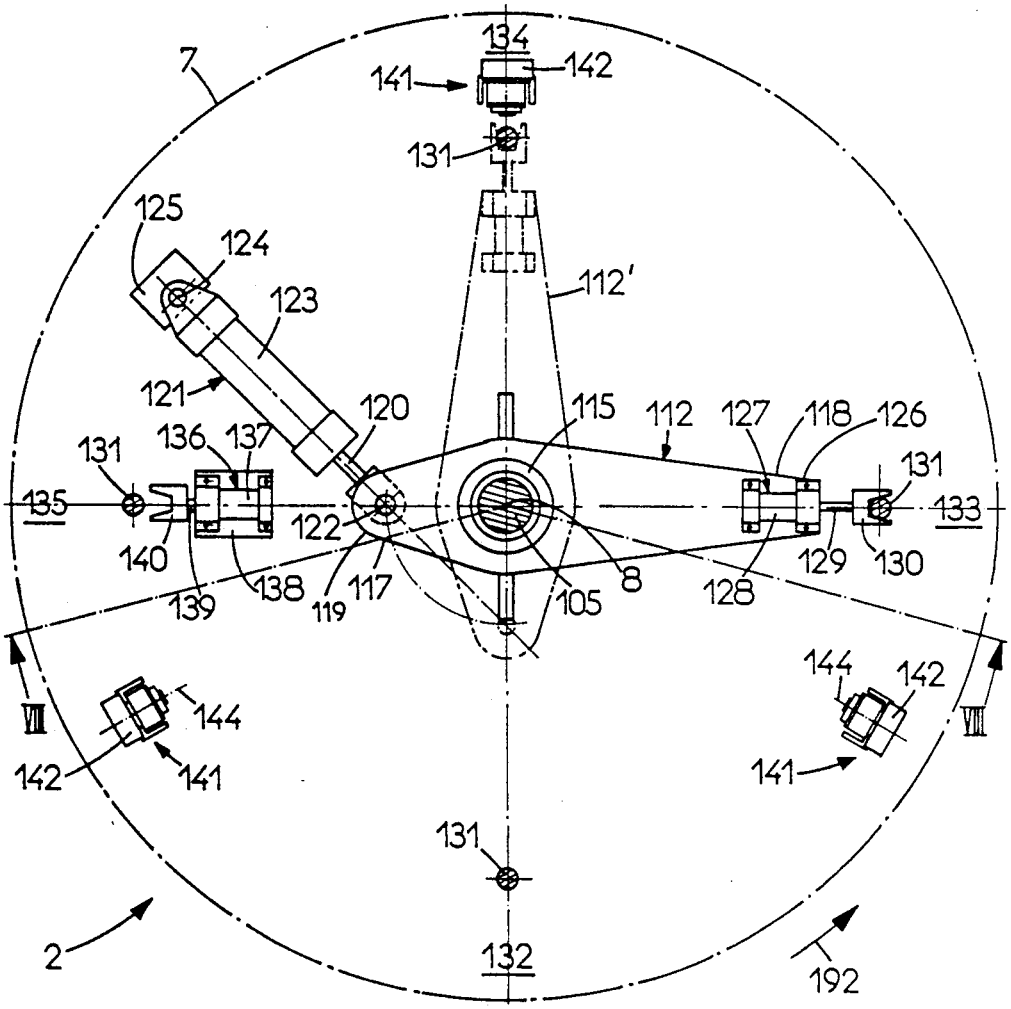
FIG. 9 shows a top view partially in section along IX (FIG. 8) of the table shown in FIG. 8.

Arm (118) supports at its free end (126) a cylinder (127) whose cylinder (128) is attached to arm (118). The free end of rod (129) of cylinder (127) is integral with a V-shaped part (130) whose V opens outward. When rod (129) of cylinder (127) is outside, V-shaped part (130) cooperates with an index (131) integral with table (7). This index (131) consists of a cylindrical stud which, when it cooperates with V-shaped part (130), extends between the wings of the V. In FIG. 9, it is seen that table (7) comprises four indexes (131). It will be noted that the number of indexes (131) that table (7) comprises corresponds to the number of core boxes (3; 4; 5; 6) provided to be supported simultaneously by table (7). In the example shown, table (7) can simultaneously support four core boxes. In (132), the disassembly, the extraction of shot and gassed cores and the reassembly of core boxes is carried out. (133) corresponds to an intermediate position. In (134), the shooting of the core is carried out, and in (135), the gassing of the core is carried out.

Another cylinder (136) also is provided to cooperate with an index (131) of table (7). Cylinder (137) of this cylinder (136) is attached to a standard (138) integral with base (13). The free end of rod (139) of the cylinder (136) also comprises a V-shaped part (140) similar to V-shaped part (130) of cylinder (127).

Cylinder (127) cooperates with an index (131) to make table (7) turn around rotation axis (8) whereas cylinder (136) cooperates with an index (131) during the work to block the rotation of table (7).

The mechanism which was just described and serving to make table (7) turn (by a quarter turn in the embodiment example) and to block table (7) during the work, operates in the following manner. Dive cylinder (127) is driven so that V-shaped drive part (130) is brought to cooperate with an index (131) of table (7). Then, blocking cylinder (136) is driven to disengage V-shaped blocking part (140) from index (131) with which it was cooperating. Then, drive cylinder (121) is driven so as to make its rod (120) go out. Doing this, rod (120) pushes on arm (117) of lever (112) causing the rotation of the latter around axis (8). As V-shaped drive part (130) of drive cylinder (127) cooperates with an index (131) of table (7), the rotation of lever (112) also will cause the rotation of table (7) around axis (8). The travel of drive cylinder (121) is such that table (7), performs a quarter turn in the example described. When drive cylinder (121) is at the end of the extension travel, lever (112) is in position (112') shown in dot-dash lines in FIG. 9. At this time, blocking cylinder (136) again is driven to make its rod (139) go out so that V-shaped blocking part (140) of the cylinder (136) can engage with index (131) which has been brought opposite it during the rotation of table (7). Then, drive cylinder (127) is driven to disengage it from index (131) with which it was cooperating during the rotation of table (7). Finally, drive cylinder (121) is driven so that its rod (120) again returns to cylinder (123). Doing this, rod (120) draws on lever (112). When drive cylinder (121) is at the end of retraction travel (position in solid lines in FIG. 9), the mechanism is again ready for a new rotation of table (7).

In FIGS. 9, 10 and 11, it is seen that table (7) also rests on supports (141) of which at least one extends in zone (134) of shooting device (10) approximately in axis (53) of shooting unit (202). This support (141) makes it possible for table (7) to absorb well the impact generated during the shooting of the core. (In FIG. 1, supports (141) have not been shown so as not to encumber the figure).

In the embodiment example described, supports (141) are three in number and are located equidistantly from one another. They consist of rollers (142) which are attached to the upper part of standards (143) integral with base (13), as appears in FIGS. 10 and 11. Rollers (142) turn around approximately horizontal axes (144), approximately cutting rotation axis (8) of table (7). In the example, standards (143) consist of U-shaped sections. Each standard (143) is equipped at its upper part with a roller-holder arm (145) which extends between two wings (146; 147) of the U-shaped section. At its upper end, roller-holder arm (145) supports roller (142) in rotation. Between its two ends, roller-holder arm (145) is equipped with an oblong hole (148) which a bolt (149) goes through. This bolt (149) also further goes through a hole (150) provided in core (151) of standard (143). At its lower end, roller-holder arm (145) is in contact with an adjusting bolt (152) which is screwed into a nut (153) integral with standard (143).

Due to this arrangement, the position of each roller (142) can be adjusted relative to table (7). To bring roller (142) into contact with table (7), bolt (149) is unscrewed, then metering bolt (152) is pushed on the lower end of roller-holder arm (145), which will cause the slippage of roller-holder arm (145) in standard (143). This slippage is possible, since hole (148), provided in roller-holder arm (145) and which bolt (149) goes through, is an oblong hole. When roller (142) is in contact with table (7), it then will be sufficient to tighten bolt (149) to connect roller-holder holder arm (145) rigidly to its standard (143).

FIGS. 12 and 13 show an embodiment of holding means (154) of core boxes (3; 4; 5; 6). These holding means (154) maintain the core boxes during the work. Since they are identical, it will be enough to describe a single one of them. (In FIG. 12, for the sake of clarity of the figure, only holding devices (154) of stations (181 and 183) have been shown.)

Holding means (154) comprises a jaw-holder (155) which is equipped with two jaws (156; 157). Each jaw-holder (155) comprises a bearing (158) integral with two wings (159; 160) so that in top view, the two wings (159; 160) form a U opening outward. In the rear, bearing (158) is open to form a clamp (161) which can be tightened by a bolt (162). Bearing (158) of jaw-holder (155) is slid over a stud (163) attached to the upper face of table (7). Jaw-holder (155) further comprises a control cylinder (164), which is attached on top of bearing (158) of jaw-holder (155), above bearing (158). Control cylinder (164) is sealed at its upper part (165). This sealed upper part (165) is penetrated by an adjusting bolt (166) which is screwed into a threaded hole (167) placed in the longitudinal axis of stud (163). Adjusting bolt (166) is connected in translation to control cylinder (164) and a control wheel (168) is attached to its part which projects beyond control cylinder (164).

The device which was just described makes it possible to adjust the position of jaw-holder (155) and consequently jaws (156; 157) relative to the dimension of the core box that they are to maintain. To do this, it is sufficient to unscrew bolt (162) to open clamp (161), then to make adjusting bolt (166) turn with wheel (168) to make adjusting bolt (166) enter or go out from stud (163). When jaws (156; 157) have reached the good position relative to the core box, it will be sufficient to tighten clamp (161) by tightening bolt (162).

Two slides (169; 170), on which jaws (156; 157) can slide, extend between two U-shaped wings (159; 160). A cylinder (171), whose cylinder (172) is attached to one (156) of the jaws and whose rod (173) is attached to the other jaw (157), extends between the two slides (169; 170).

One (169) of the slides comprises a certain number of holes (174), in which two pins (175) can be attached on both sides of one (156) of the jaws and which will serve to connect in translation one (156) of the jaws to one (169) of the slides. In this way, the core box intended for this holding means (154), always will be approximately in the same place on table (7), i.e. advantageously centered relative to shooting head (203-202; 204-202) and gassing head (12).

The closing of jaws (156; 157) is performed by controlling cylinder (171) to make its rod (173) return to its cylinder (172). This will move jaw (157) which can slide freely on slides (169; 170) until it comes into contact with the core box to be held. The holding of the core box is obtained by maintaining, for example, pressure in cylinder (171).

In FIG. 13, it also is seen that the two jaws (156; 157) are different from one another. Actually, jaw (157) comprises a swiveling clamping plate (176). For this purpose, jaw (157) comprises a yoke (177) attached on its connecting part (178) to slides (169; 170). Clamping plate (176) is connected to the end of this yoke (177) by a ball joint (179). In this way, swiveling clamping plate (176) can be positioned well relative to the core box if the latter does not comprise parallel faces. This guarantees an optimal holding of the core box.

In FIG. 13, it also is seen that each station (180; 181; 182; 183) is equipped with an index (184; 185; 186; 187) which is attached to table (7). These indexes (184; 185; 186; 187) are arranged on circles (188; 189; 190; 191) of different radius and are centered on rotation axis (8) of table (7). These indexes (184; 185; 186; 187) pass during the rotation of table (7) which always is carried out in the same direction (192), above sensors (193; 194; 195; 196) which are attached to base (13) and which consequently do not turn with table (7). Each sensor (193; 194; 195; 196) is located at a distance from rotation axis (8) of table (7) equal to the radius of circle (188; 189; 190; 191) on which corresponding index (184; 185; 186; 187) turns.

The passage of an index (184; 185; 186; 187) over its sensor (193; 194; 195; 196) is transmitted to a programmable computer (197) and will indicate, for example, to the computer (197) the beginning of the cycle performed by each core box (3; 4; 5; 6) for which the shooting head (203-202; 204-202) to be used, the necessary number of shots as well as the gassing time will have been programmed on computer (197).

Thus, when a core box (3; 4; 5; 6) is in zone (134) where the shooting operation is carried out, computer (197) controls cylinder (211) which brings, under shooting unit (202), metering device (203; 204) intended to supply the core box (3; 4; 5; 6) and which will have been supplied previously with sand by corresponding hopper (198; 199).

In the example shown, nozzles (205; 206) of metering devices (203; 204) have output orifices (207; 208) of different shape. It will be understood, however, that in the invention, these output orifices (207; 208) can be of the same shape. Moreover, hoppers (198; 199) can contain different sands.

These different characteristics reinforce the flexible nature of the machine. Actually, if the user has to produce several cores of very different shape simultaneously, necessitating output nozzles (205; 206) with different output orifice (207; 208), and, moreover, having to be made with different sands, the two hoppers (198; 199) will be supplied with different sands and the suitable output nozzle will be mounted on each metering device (203; 204). On the other hand, if the user has to produce several cores of very different shape, but in the same sand, simultaneously, suitable output nozzle (205; 206) will be mounted on each metering device (203; 204) and the two hoppers (198; 199) will be supplied with the same sand. If, finally, the user has to produce cores of similar shape, but in different sands, simultaneously, same output nozzles (205; 206) will be mounted on metering devices (203; 204) and hoppers (198; 199) will be supplied with different sands. It also is possible to have more than two shooting heads (203-202; 204-202).

Finally, it is perfectly possible that the machine be equipped to support a number of core boxes different from four.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A core shooter comprising:

a shooting device;

a sand supply means for supplying sand to said shooting device; and a support means for core boxes, said support means being equipped with support elements which can simultaneously receive a plurality of core boxes, said support means being further equipped with means for alternatively bringing each one of said plurality of core boxes in a shooting zone opposite said shooting device;

wherein:

said shooting device comprises a plurality of shooting heads each formed by a metering device and a shooting unit, and which can be utilized during the same cycle of production, each one of said plurality of shooting heads having a metering device, whereas a shooting unit is common to at least some of said plurality of shooting heads; and said sand supply means comprises a plurality of individual supplies of sand for supplying sand to said metering devices.

2. The core shooter according to claim 1, wherein said metering devices corresponding to said common shooting unit move jointly when said shooting head which is operation, is moved to or moved away from the one of said plurality of core boxes which is in said shooting zone.

3. The core shooter according to claim 1, wherein in a nonuse position, at least one of said metering devices extends under a corresponding one of said plurality of supplies of sand.

4. A core shooter according to claim 1, wherein said supplies of sand extend around said common shooting unit.

5. A core shooter according to claim 1 wherein:

said shooting device further comprises a control device;

said common shooting unit is stationary; and said metering device, adapted to the core box to be shot, is brought under said common shooting unit by said control device.

6. The core shooter according to claim 5, wherein said metering devices are brought under said common shooting unit by movement in an at least substantially horizontal plane.

7. The core shooter according to claim 6, wherein said metering devices are brought under said common shooting unit by translation in said at least substantially horizontal plane.

8. The core shooter according to claim 5, wherein said common metering devices corresponding to said shooting unit move jointly when said control device brings one of said metering devices under said common shooting unit.

* * * * *